US010458597B2

(12) United States Patent
Joh et al.

(10) Patent No.: US 10,458,597 B2
(45) Date of Patent: Oct. 29, 2019

(54) INSULATION PANEL FOR CORNER AREA OF LNG CARGO CONTAINMENT SYSTEM

(71) Applicant: SAMSUNG HEAVY IND. CO., LTD., Seoul (KR)

(72) Inventors: Ki-Hun Joh, Geoje-Si (KR); Sang-Eon Chun, Geoji-Si (KR); Chang-Seon Bang, Geoji-Si (KR); Dai-Gil Lee, Youseong-gu (KR); Byung-Chul Kim, Yeonje-gu (KR); Bu-Gi Kim, Buk-gu (KR); Jin-Gyu Kim, Changwon-si (KR); Soon-Ho Yoon, Nam gu (KR); Sang-Wook Park, Nam-gu (KR); Kwan-Ho Lee, Guro gu Guro-1 dong (KR); Byoung-Jung Kim, Sunchang-gun (KR); Po-Chul Kim, Cheongdo-gun (KR); Ha-Na Yu, Mungyeong-si (KR)

(73) Assignee: SAMSUNG HEAVY IND. CO., LTD., Seoul (KR)

( * ) Notice: Subject to any disclaimer, the term of this patent is extended or adjusted under 35 U.S.C. 154(b) by 166 days.

(21) Appl. No.: 15/298,902

(22) Filed: Oct. 20, 2016

(65) Prior Publication Data

US 2017/0038007 A1 Feb. 9, 2017

Related U.S. Application Data

(63) Continuation of application No. 12/946,415, filed on Nov. 15, 2010, which is a continuation of application No. PCT/KR2009/003311, filed on Jun. 19, 2009.

(30) Foreign Application Priority Data

Jun. 20, 2008 (KR) ..... 10-2008-0058095
Jun. 16, 2009 (KR) ..... 10-2009-0053571

(51) Int. Cl.
*F17C 3/02* (2006.01)
*B63B 25/16* (2006.01)

(52) U.S. Cl.
CPC ..... *F17C 3/02* (2013.01); *B63B 25/16* (2013.01); *F17C 3/027* (2013.01);
(Continued)

(58) Field of Classification Search
CPC .... B65D 90/04; B65D 90/024; B65D 90/023; B65D 90/021; B65D 90/02; B65D 52/16;
(Continued)

(56) References Cited

U.S. PATENT DOCUMENTS 3,929,247 A * 12/1975 Borup ..... B65D 81/18 114/74 A
4,128,069 A * 12/1978 Kotcharian ..... F17C 3/04 114/74 A (Continued)

FOREIGN PATENT DOCUMENTS

JP 1973-100716 12/1973
JP 1975-002148 1/1975

(Continued)

OTHER PUBLICATIONS

Chinese Office Action for Chinese Application 200980123421.0, dated Mar. 28, 2012.

(Continued)

*Primary Examiner* — James N Smalley
*Assistant Examiner* — Madison L Poos
(74) *Attorney, Agent, or Firm* — Brinks Gilson & Lione

(57) ABSTRACT

The present invention is related to a corner panel of an LNG cargo that includes a main body, which constitutes a corner area of the cargo, and a stress diverging part, which reduces the convergence of stress of the main body by being integrated with an internal face of the main body and being (Continued)

formed with curvature. Therefore, by forming the corner area of the LNG cargo in a single body having a round-shaped curvature, convergence of stress caused by the deformation of the hull and thermal deformation can be prevented, and possibility of crack in a secondary barrier can be removed. By allowing the secondary barrier to be formed in a curved shape, the constructability of the secondary barrier can be greatly improved. Since no hardwood key or plywood is required, the thickness of a primary barrier can be reduced as the stress is decreased and the reliability of the secondary barrier is improved, and the weight can be greatly reduced over the conventional cargo corner area.

7 Claims, 13 Drawing Sheets

(52) U.S. Cl.
CPC ..... *F17C 2203/0333* (2013.01); *F17C 2203/0358* (2013.01); *F17C 2203/0631* (2013.01); *F17C 2203/0663* (2013.01); *F17C 2205/0196* (2013.01); *F17C 2209/221* (2013.01); *F17C 2209/227* (2013.01); *F17C 2209/228* (2013.01); *F17C 2209/23* (2013.01); *F17C 2221/033* (2013.01); *F17C 2223/0161* (2013.01); *F17C 2223/033* (2013.01); *F17C 2260/033* (2013.01); *F17C 2260/036* (2013.01); *F17C 2270/01* (2013.01); *F17C 2270/0107* (2013.01)

(58) Field of Classification Search
CPC .... F17C 3/02; F17C 3/027; F17C 2203/0333; F17C 2203/0358; F17C 2203/0631; F17C 2221/003; F17C 2223/0161; F17C 2223/033; F17C 2260/036; F17C 2270/01; F17C 2270/0107
USPC ..... 206/586, 453; 220/560.12, 560.11, 220/560.07, 560.05, 560.04
See application file for complete search history.

(56) References Cited

U.S. PATENT DOCUMENTS

| | | | | |
|---|---|---|---|---|
| 5,501,359 | A * | 3/1996 | Chauvin | B63B 25/16 220/560.12 |
| 6,035,795 | A * | 3/2000 | Dhellemmes | B63B 25/16 114/74 A |
| 2006/0117566 | A1 | 6/2006 | Yang et al. | |
| 2008/0053993 | A1 | 3/2008 | Yang et al. | |

FOREIGN PATENT DOCUMENTS

| | | | |
|---|---|---|---|
| JP | 1982-205644 | | 12/1982 |
| JP | 1984-170367 | | 9/1984 |
| KR | 20-0345090 | Y1 | 3/2004 |
| KR | 10-0499710 | B1 | 7/2005 |
| KR | 10-2006-0076564 | A | 7/2006 |
| KR | 10-0613164 | | 8/2006 |
| KR | 10-0649317 | B1 | 11/2006 |
| WO | WO2006-062271 | A1 | 6/2006 |

OTHER PUBLICATIONS

Japanese Office Action for Japanese Application 2011-507359 dated Aug. 14, 2012.

* cited by examiner

INSULATION PANEL FOR CORNER AREA OF LNG CARGO CONTAINMENT SYSTEM

RELATED APPLICATIONS

The present patent document is a continuation of U.S. application Ser. No. 12/946,415, filed Nov. 15, 2010, which is a continuation and claims the benefit of priority under 35 U.S.C. § 120, 365, and 371 to Patent Cooperation Treaty Patent Application No. PCT/KR2009/003311, filed on Jun. 19, 2009 which claims the benefit and priority to Korean Application Nos. 10-2008-0058095, filed Jun. 20, 2008, and 10-2009-0053571, filed Jun. 16, 2009. The disclosures of the foregoing applications are hereby incorporated by reference in their entireties.

TECHNICAL FIELD

The present invention is related to a corner panel of an LNG cargo.

BACKGROUND

LNG (liquefied natural gas) generally refers to colorless, transparent cryogenic liquid converted from natural gas (predominantly methane) that is cooled to approximately −162□ and condensed to $1/600^{th}$ the volume.

As LNG emerges as an energy source, efficient transportation means have been sought in order to transport LNG from a supply site to a demand site in a large scale so as to utilize LNG as energy. Resulted in a part of this effort is LNG carriers, which can transport a large quantity of LNG by sea.

LNG carriers need to be furnished with a cargo that can keep and store cryogenically liquefied LNG, but such carriers require intricate and difficult conditions.

That is, since LNG has vapor pressure that is higher than atmospheric pressure and boiling point of approximately −162□, the cargo that stores LNG needs to be constructed with materials that can withstand very low temperature, for example, aluminum steel, stainless steel and 33% nickel steel, and designed in a unique insulation structure that can withstand thermal stress and thermal contraction and can be protected from heat leakage, in order to keep and store LNG safely.

Described below with reference to the accompanying drawings is the insulation structure of a conventional LNG carrier cargo.

FIG. 1 is a sectional view illustrating a conventional insulation structure of an LNG carrier cargo. As illustrated, a bottom insulation panel 10 is adhered and fixed by way of a fixing plate 10*a* to an internal face of a hull 1 of an LNG carrier by epoxy mastic 13 and a stud bolt 14.

Here, interposed and adhered in between the bottom insulation panel 10 and a top insulation panel 20 is a rigid triplex 22. When the bottom insulation panel 10 is adhered to a cargo wall, the bottom insulation panel 10 is formed with a gap 40 so that a flat joint 18 made of a glass wool material can be inserted in the gap 40 formed between bottom insulation panels 10.

Then, a top bridge panel 28 is attached in between the top insulation panels 20 by adhering a supple triplex 26 over the rigid triplex 22, which is already attached, with epoxy glue 24 and then adhering the top bridge panel 28 over the supple triplex 26 with epoxy glue 24.

The top insulation panel 20 and an upper part of the top bridge panel 28 have a same planar surface, on which a corrugated membrane 30 is attached by way of an anchor strip 32 to complete the cargo wall.

Looking at how the internal face of the hull 1 and the bottom insulation panel 10 of an LNG carrier are assembled in further detail, the stud bolt 14 is adhered to an inner wall of the hull 1 by resistance welding, and a hole, through which the stud bolt 14 can be inserted, is pre-formed in the bottom insulation panel 10. Accordingly, assembly is completed by engaging a nut 14*a* with the stud bolt 14 and inserting a cylinder-shaped foam plug 15 in the hole formed in the bottom insulation panel 10.

As corner areas of the cargo of the conventional LNG carrier need to be made more rigid than other flat areas, the structure of a corner of the cargo of the LNG carrier will be described below with reference to the accompanying drawings.

FIG. 2 is a sectional view illustrating a structure of a cargo insulation corner of an LNG carrier in accordance with a conventional embodiment of U.S. Pat. No. 6,035,795.

As illustrated, two sheets 51 of insulating material intersect each other to form the corner of the cargo, and installed on an internal side toward the inside of the cargo at a region where these sheets 51 intersect is an insulating sheet 52, which is attached in between two wooden boards 53. In order to prevent a secondary barrier from cracking due to deformation of the hull and thermal deformation caused by the cryogenic LNG, the wooden boards 53 are used for the corner area, unlike the flat areas.

FIG. 3 is a sectional view illustrating a structure of a cargo insulation corner of an LNG carrier in accordance with another conventional embodiment of U.S. Pat. No. 6,378,722.

As illustrated, a flexible gasket 62 is installed at an intersecting region of insulation layers 61 that corresponds to a corner area of the cargo, and corrugations (not shown) are formed in a primary barrier (not shown) in order to prevent stress caused by thermal contraction from converging at the corner area, thereby reducing the stress applied to the corner area.

Referring back to FIG. 1, the corrugated membrane 30, which is the primary barrier, is directly contacted with LNG. In a large capacity cargo, the LNG inside the cargo may slosh, thereby applying pressure to the cargo, if the LNG carrier is rolled or pitched due to the waves or winds.

The pressure caused by sloshing affects the corrugated membrane 30, which is in direct contact with LNG, and the top insulation panel 20, which is in contact with the corrugated membrane 30. Here, if the impact load and stress caused by the pressure exceed the rigidity of the corrugated membrane 30 and the top insulation panel 20, plastic deformation and crack may occur, lowering the safety of the LNG cargo.

Particularly, a joint area of the corrugated membrane 30, which is the primary barrier, and the top insulation panel 20, which is the insulator, is more vulnerable to the impact load and stress caused by the deformation and sloshing of the hull.

As described above, the structure of the corner area of the cargo of the LNG carrier in accordance with the conventional art has been constructed rigidly by use of thick plywood, called hard-wood key, or has been corrugated to reduce the stress. However, as the structure is non-continuous, the stress generated due to the sloshing, the deformation of the hull and the change in temperature converges at the corner area. Moreover, it is difficult to undertake the construction of the secondary barrier since the corner area forms an acute angle, and the weight is greatly increased since a material such as plywood is used.

SUMMARY

Contrived to solve the above-described problems, the present invention prevents stress from being converged at the corner area of the LNG cargo due to the deformation of the hull and the thermal deformation, removes the possibility of crack in the secondary barrier while improving the constructability, decreases the thickness of the primary barrier, mitigates the impact load and stress caused by sloshing, and reduces the weight of the corner area over the conventional corner area.

To solve the above problems, an aspect of the present invention provides a corner panel of an LNG cargo, which includes: a main body arranged at a corner area of the cargo, an internal face of the main body having curvature; and a stress diverging part including a curvature member and configured to reduce convergence of stress of the main body, an external face of the curvature member being adhered to the internal face of the main body.

The main body can also include a secondary barrier, which is interposed between the main body and the curvature member. The secondary barrier can have curvature such that either face of the secondary barrier is tightly adhered to the internal face of the main body and the external face of the curvature member. The secondary barrier can be made of a rigid triplex or a metal foil.

The width and length of the stress diverging part can be smaller than those of the main body, and the stress diverging part can be adhered to a central area of the internal face of the main body so that boundaries of the internal face of the main body are exposed around the stress diverging part.

The stress diverging part can also include a primary barrier adhered to an internal face of the curvature member. The primary barrier can be made of stainless steel, and a stud bolt can be installed on an internal face of the primary barrier. The stress diverging part can also include a glass fiber complex interposed between the curvature member and the primary barrier.

A slit can be formed between the internal face of the main body and the external face of the curvature member.

A slope in the shape of a planar surface or a curved surface can be formed at boundaries of the curvature member.

The stress diverging part can also include a shock-absorbing member interposed between the curvature member and the primary barrier. A lubricant can be coated on both faces of the shock-absorbing member.

The stress diverging part can also include a composite or a plywood panel interposed between the curvature member and the shock-absorbing member. The composite can be molded by mixing epoxy resin in glass fiber, carbon fiber or a compound of glass fiber and carbon fiber. The shock-absorbing member can be one of a plate, a sheet and a mesh. The shock-absorbing member can be a plurality of tubes in which a hollow part is formed. The shock-absorbing member can be a plurality of elastic bodies, for which a spring can be used.

The diverging part can include: a composite of a plywood panel interposed between the curvature member and the primary barrier; a supplementary shock-absorbing member interposed between the composite or plywood panel and the primary barrier; a metal adhesive plate interposed between the supplementary shock-absorbing member and the primary barrier; and a plurality of fastening members coupling the supplementary shock-absorbing member and the metal adhesive plate to the plywood panel. A boundary area of the primary barrier can be welded on an upper face of the metal adhesive plate.

By forming a corner area of an LNG cargo in a single body having a round-shaped curvature, convergence of stress caused by the deformation of the hull and thermal deformation can be prevented, and possibility of crack in a secondary barrier can be removed. By allowing the secondary barrier to be formed in a curved shape, the constructability of the secondary barrier can be greatly improved. Since no hardwood key or plywood is required, the thickness of a primary barrier can be reduced as the stress is decreased and the reliability of the secondary barrier is improved, and the weight can be greatly reduced over the conventional cargo corner area.

Furthermore, by mitigating impact load or stress exerted on the primary barrier by use of a shock-absorbing member, the stability of a corner panel of the cargo can be improved.

DETAILED DESCRIPTION

Hereinafter, some embodiments of the present invention will be described with reference to the accompanying drawings. In describing the present invention, when it is determined to obscure the gist of the present invention if certain known relevant elements or functions are described in detail, such description will be omitted.

Figure 1:
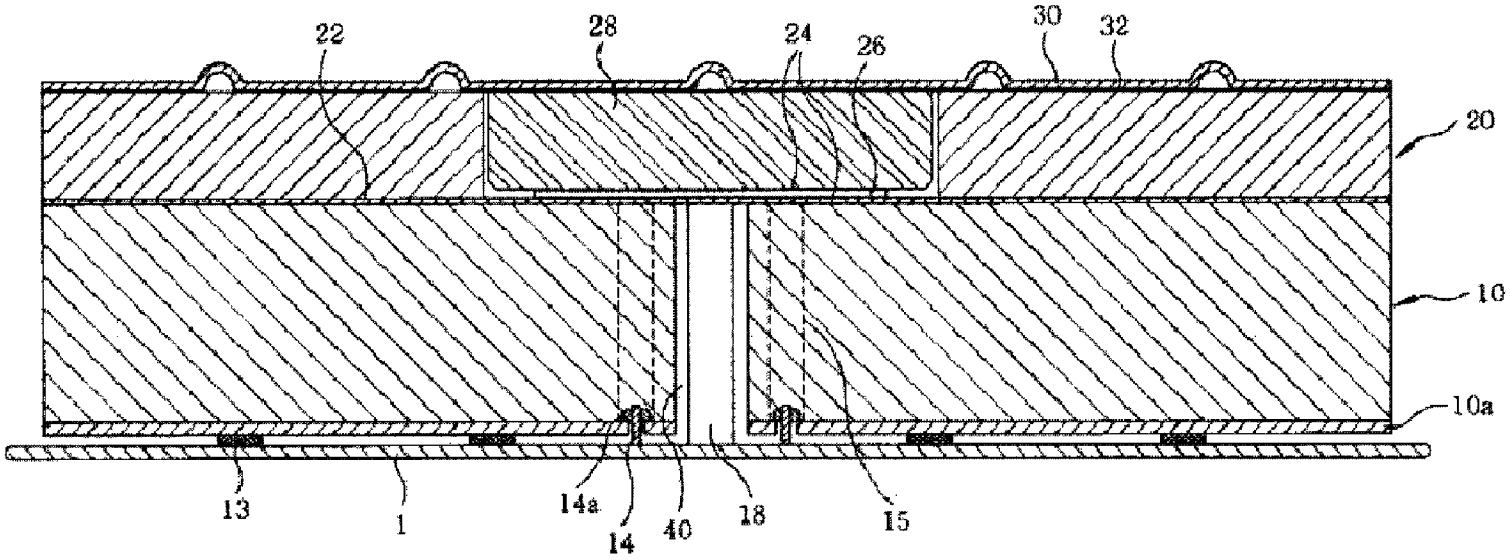
FIG. 1 is a sectional view illustrating a cargo insulation structure of an LNG carrier in accordance with the conventional art.
Figure 2:
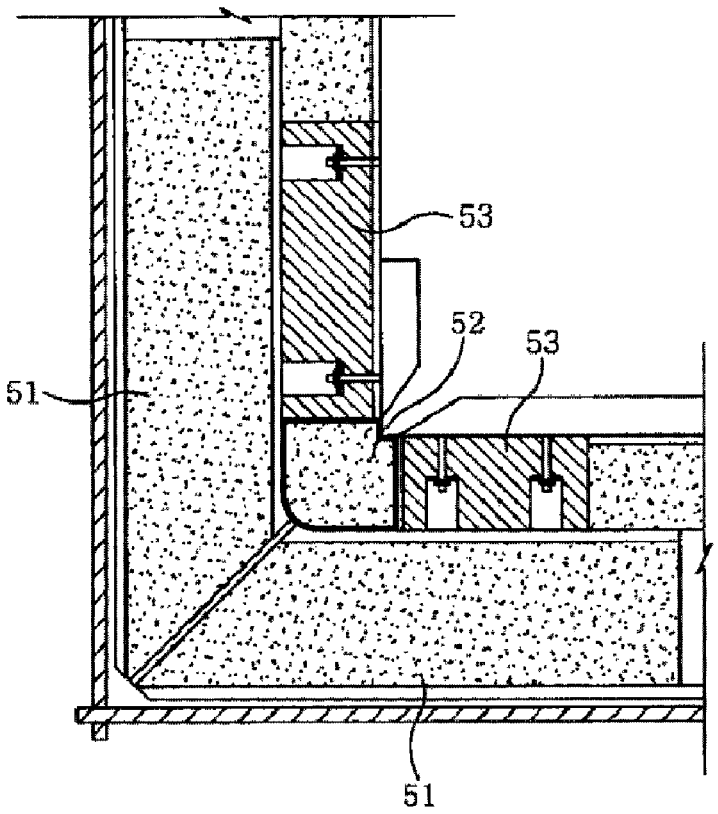
FIG. 2 is a sectional view illustrating the structure of an insulation corner area of a cargo of an LNG carrier in accordance with a conventional embodiment.
Figure 3:
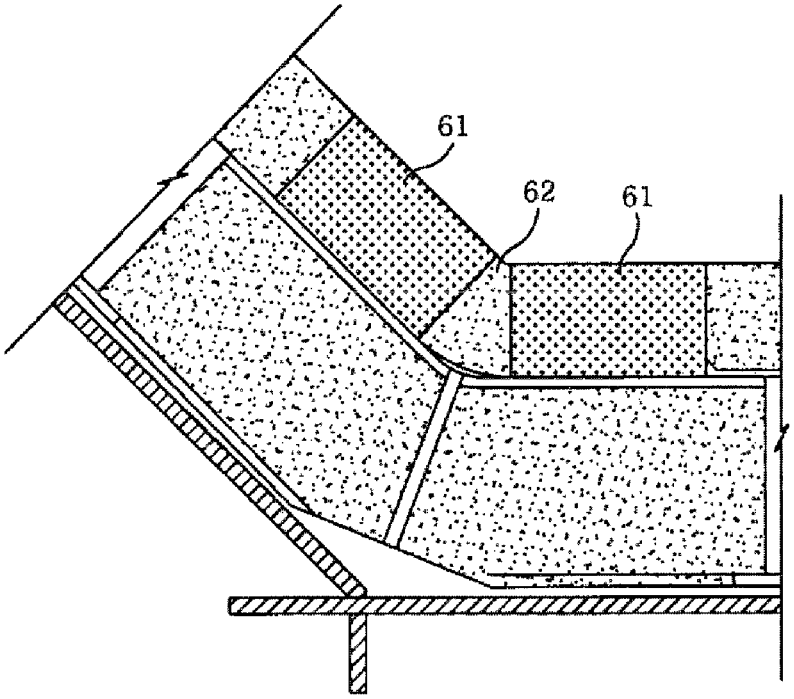
FIG. 3 is a sectional view illustrating the structure of an insulation corner area of a cargo of an LNG carrier in accordance with another conventional embodiment.
Figure 4:
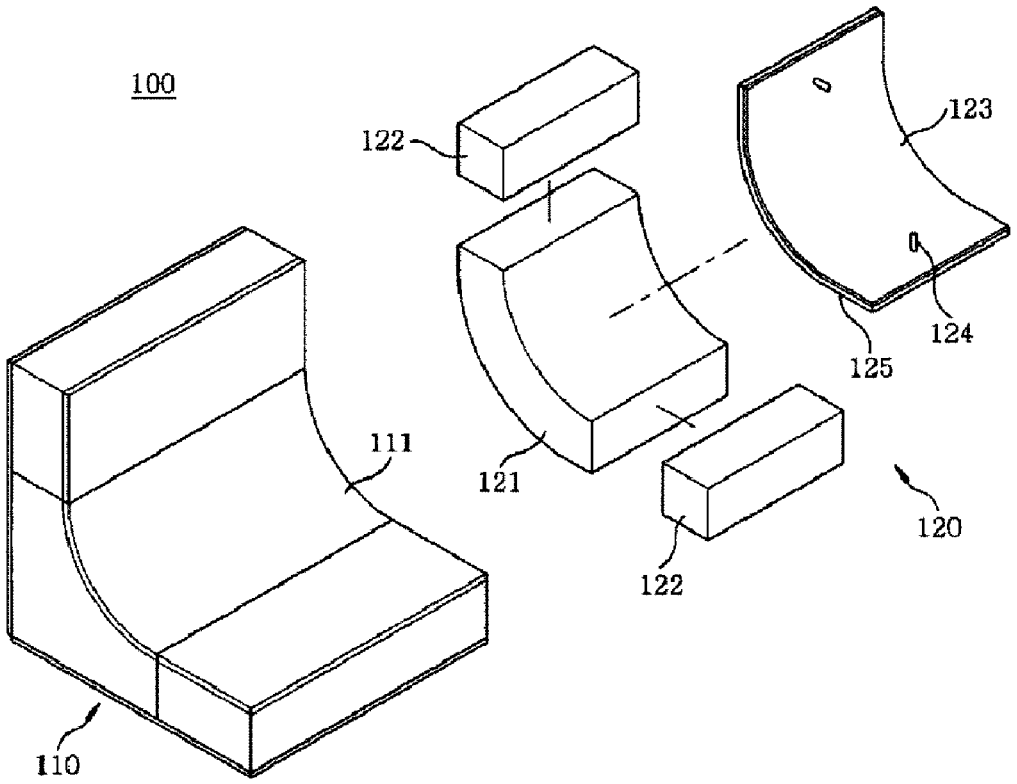
FIG. 4 is an exploded perspective view illustrating a corner panel of an LNG cargo in accordance with a first embodiment of the present invention.
Figure 5:
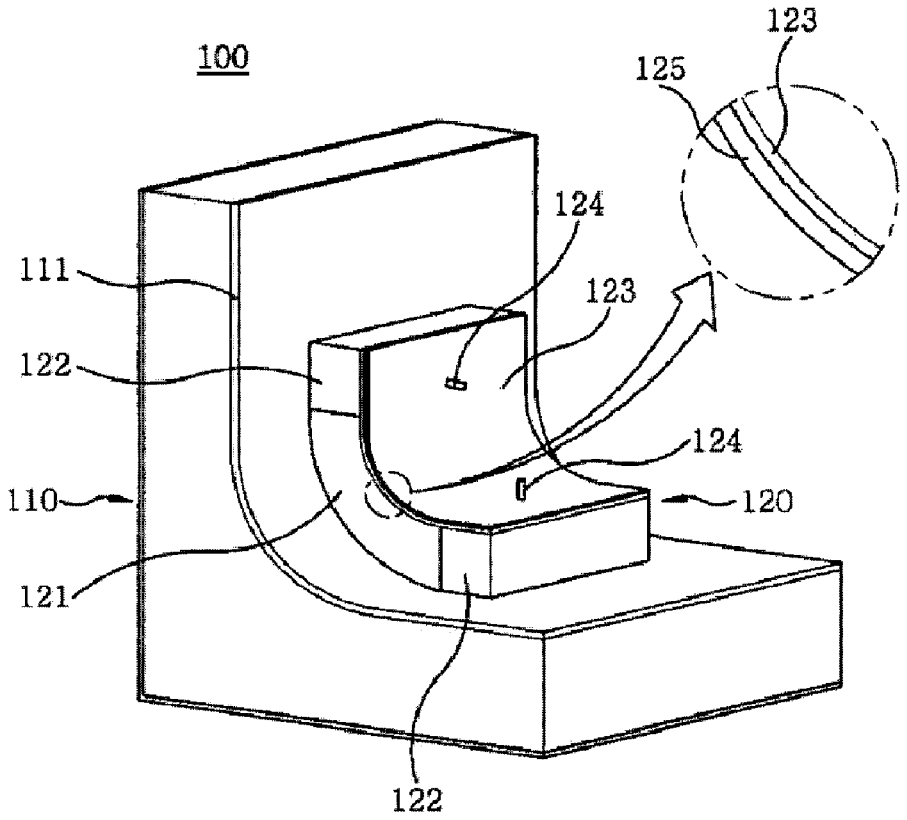
FIG. 5 is a perspective view illustrating the corner panel of an LNG cargo in accordance with the first embodiment of the present invention.

FIG. 4 is an exploded perspective view illustrating a corner panel of an LNG cargo in accordance with a first embodiment of the present invention, and FIG. 5 is a perspective view illustrating the corner panel of an LNG cargo in accordance with the first embodiment of the present invention.

As illustrated, a corner panel 100 of an LNG cargo in accordance with an embodiment of the present invention includes a main body 110, which constitutes a corner area of the LNG cargo, and a stress diverging part 120, which is integrated with an internal face of the main body 110.

The main body 110 is made of a thermal insulation material, for example, polyurethane foam, for preventing heat leakage of the cargo and is arranged at a corner area of the cargo where two flat areas meet in order to connect the flat areas that are adjacently arranged near the corner area to each other.

Interposed between an internal face of the main body 110 and the stress diverging part 120 is a secondary barrier 111, which is adhered to the internal face of the main body 110 by an adhesive.

The secondary barrier 111 is made of, for example, a rigid triplex or a metal foil, and is formed to have a curvature for easy construction. Here, the internal face of the main body 110 is formed to have a curvature that is identical to that of the secondary barrier 111 so that the secondary barrier 111 can be in tight contact with the internal face of the main body 110.

The metal foil used as the secondary barrier 111 is made of aluminum or stainless steel that is flat and thin, has the same area as the internal face of the main body 110, and is adhered to the internal face of the main by use of an adhesive such as epoxy glue. Here, in order to enhance the adhesive strength between the internal face of the main body 110 and the secondary barrier 111, the surface of the secondary barrier 111 can be surface-treated by sand blasting or etching and then coated with a primer or silane.

The stress diverging part 120 is integrated with the main body 110 by being adhered to the internal face of the main body 110, that is, a surface facing the inside of the cargo, by bonding. In other words, the secondary barrier 111 is interposed between a curvature member 121, which is included in the stress diverging part 120, and the internal face of the main body 110. The curvature member 121 reduces the stress converged to the main body 110 by being formed to have a curvature in order to connect the flat areas, which intersect each other although not shown, with each other in a round shape.

In order to facilitate the assembly of the main body 110 with the flat areas, it is preferable that boundaries of the internal face of the main body 110 are partially or entirely exposed around the stress diverging part 120. Accordingly, it is possible to make the area of an external face of the stress diverging part 120 smaller than the area of the internal face of the main body 110 and to make the stress diverging part 120 adhere to a central area of the internal face of the main body 110.

In order to facilitate the processing of curvature in the stress diverging part 120, cuboidal members 122 can be coupled to either side of the curvature member 121 as illustrated, or the curvature member 121 and the cuboidal member 122 can be integrated in one body.

A primary barrier 123 is adhered to an internal face of the stress diverging part 120, which is the surface facing the inside of the cargo that is formed by the curvature member 121 and the cuboidal member 122.

The primary barrier 123 can be made of, for example, stainless steel, has curvature that corresponds to the curvature formed by the internal face of the stress diverging part 120, and has stud bolts 124 welded on an internal face thereof in order to fix a corrugated membrane or a secondary barrier fixing tool (not shown).

The primary barrier 123 can be adhered to the internal face of the stress diverging part 120 by use of an adhesive, or can be mechanically adhered by use of rivets. In case the primary barrier 123 is mechanically adhered, a glass fiber complex 125 is bonded to the internal face of the curvature member 121 of the stress diverging part 120, and the primary barrier 123 is riveted over the glass fiber complex 125. In other words, the glass fiber complex 125 is interposed between the internal face of the stress diverging part 120 and the primary barrier 123, and the primary barrier 123 is adhered to the stress diverging part by way of the glass fiber complex 125.

Figure 6:
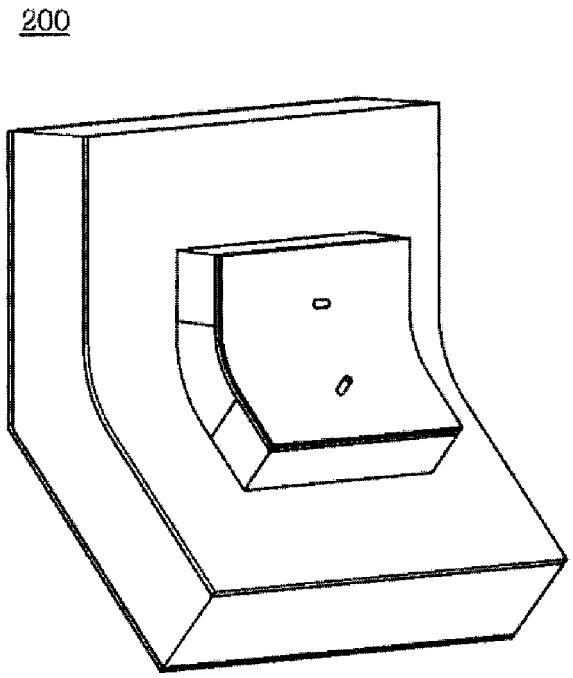
FIG. 6 is a perspective view illustrating a corner panel of an LNG cargo in accordance with a second embodiment of the present invention.
Figure 7:
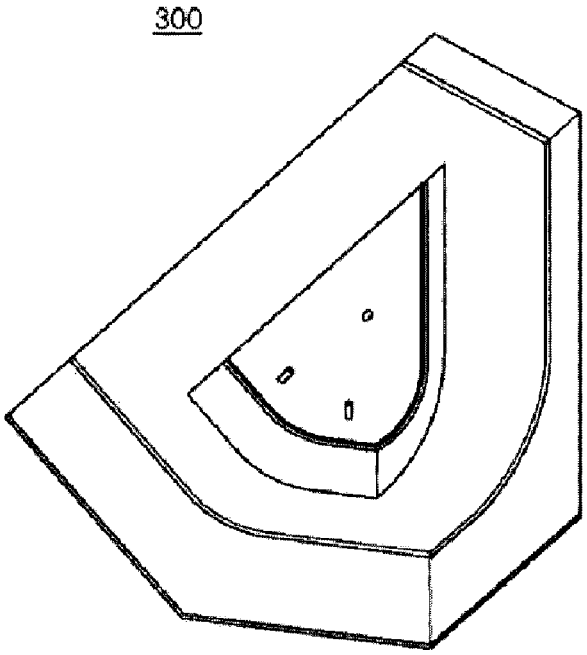
FIG. 7 is a perspective view illustrating a corner panel of an LNG cargo in accordance with a third embodiment of the present invention.

The corner panel 100 of an LNG cargo in accordance with the first embodiment of the present invention is illustrated with an example of two flat areas crossing perpendicularly in the cargo and the corner area forming a right angle. In FIG. 6, a corner panel 200 of an LNG cargo in accordance with a second embodiment of the present invention is illustrated with an example of a corner area forming an obtuse angle. In FIG. 7, a corner panel 300 of an LNG cargo in accordance with a third embodiment of the present invention is illustrated with an example of the corner panel 300 arranged at a vertex area where a plurality of flat areas, for example, three flat areas, cross one another. In other words, the corner panels of an LNG cargo in accordance with the present invention can be made in a variety of shapes depending on the location of arrangement in the cargo.

Figure 8:
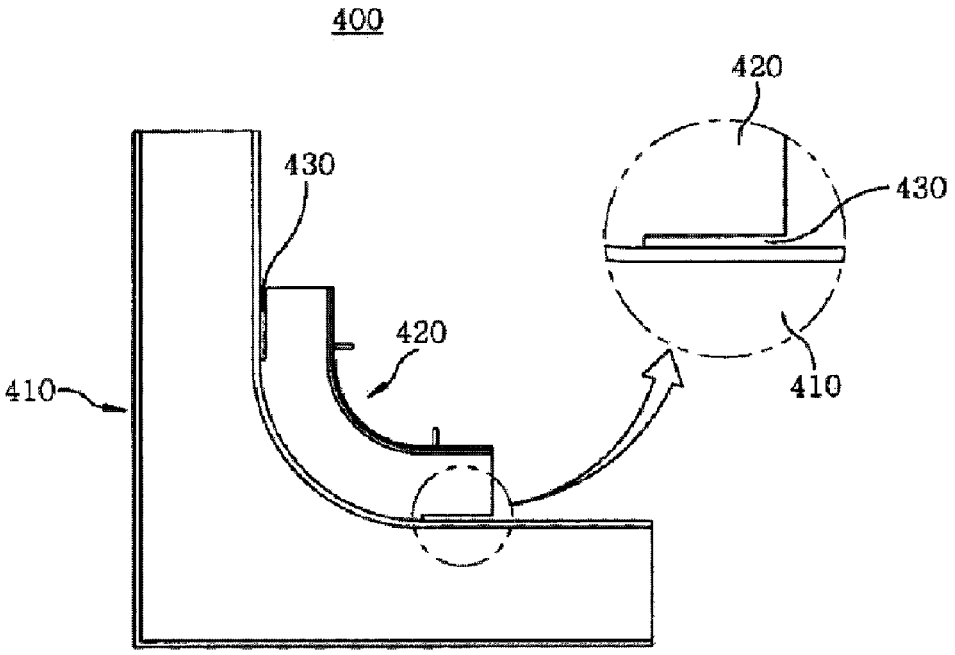
FIG. 8 is a sectional view illustrating a corner panel of an LNG cargo in accordance with a fourth embodiment of the present invention.

FIG. 8 is a sectional view illustrating a corner panel of an LNG cargo in accordance with a fourth embodiment of the present invention. A corner panel 400 of an LNG cargo in accordance with the fourth embodiment of the present invention has a slit 430 formed between a main body 410 and a stress diverging part 420, and convergence of stress is reduced because the stress is blocked by the slit 430. Here, the slit 430 can be formed partially or entirely in boundaries between the main body 410 and the stress diverging part 420, and as illustrated, the slit 430 can be formed on either boundary facing a flat area.

Figure 9:
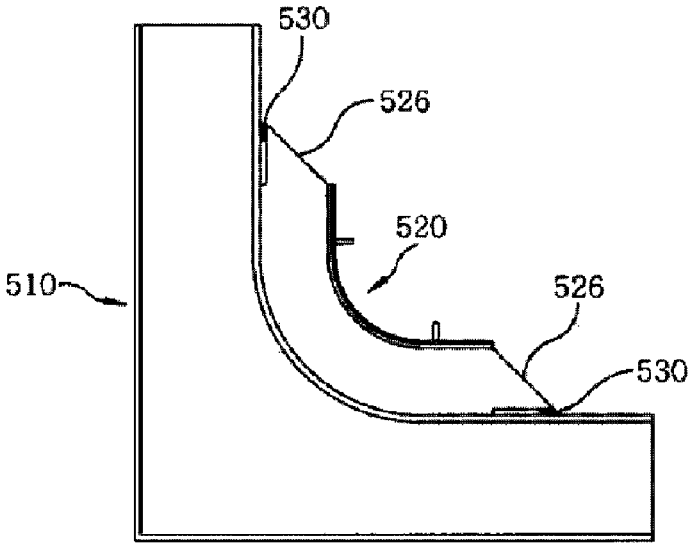
FIG. 9 is a sectional view illustrating a corner panel of an LNG cargo in accordance with a fifth embodiment of the present invention.

FIG. 9 is a sectional view illustrating a corner panel of an LNG cargo in accordance with a fifth embodiment of the present invention.

A corner panel 500 of an LNG cargo in accordance with the fifth embodiment of the present invention has slopes 526 formed entirely or partially in boundaries of a stress diverging part 520, and convergence of stress is reduced because the stress is diverged by the slopes 526.

Here, as illustrated, the slopes 526 can be formed in the shape of a planar surface or, although not shown, in the shape of a curved surface. The slopes 526 can be formed on either side of the stress diverging part 520 facing flat areas, and, like the corner panel 400 of the LNG cargo in accordance with the fourth embodiment of the present invention, both the slopes 526 and slits 530 can be formed.

The corner panel of an LNG cargo having the above structures in accordance the present invention functions as follows.

As illustrated in FIGS. 4 and 5, by integrating the stress diverging part 120, which has curvature in a round shape, with the main body 110, which constitutes the corner area of the LNG cargo, convergence of stress caused by deformation of the hull and thermal deformation can be prevented.

Possibility of crack in the secondary barrier 111, which is interposed between the main body 110 and the stress diverging part 120, is removed, and the corner panel of the LNG cargo can be manufactured more easily. By forming the secondary barrier 111 to have curvature, the constructability of the secondary barrier 11 is greatly improved. Since the conventionally-used hardwood key and plywood are not required, the thickness of the primary barrier 123 can be reduced as the stress is decreased and the reliability of the secondary barrier 111 is improved, and the weight can be greatly reduced over the conventional cargo corner area.

Since the stress diverging part 120 is bonded or mechanically coupled to the primary barrier 123 by way of the glass fiber complex 125, it becomes easier to construct the primary barrier 123.

The corner panel 100 of the LNG cargo in accordance with the present embodiments can be manufactured to have two flat areas cross each other to form the corner area with not only a right angle but also different angles, for example, an obtuse angle as in the case of the corner panel 200 of the LNG cargo in accordance with the second embodiment of the present invention illustrated in FIG. 6. Moreover, as in the case of the corner panel 300 of the LNG cargo in accordance with the third embodiment of the present invention illustrated in FIG. 7, three flat areas can cross one another to form the corner area.

Figure 10:
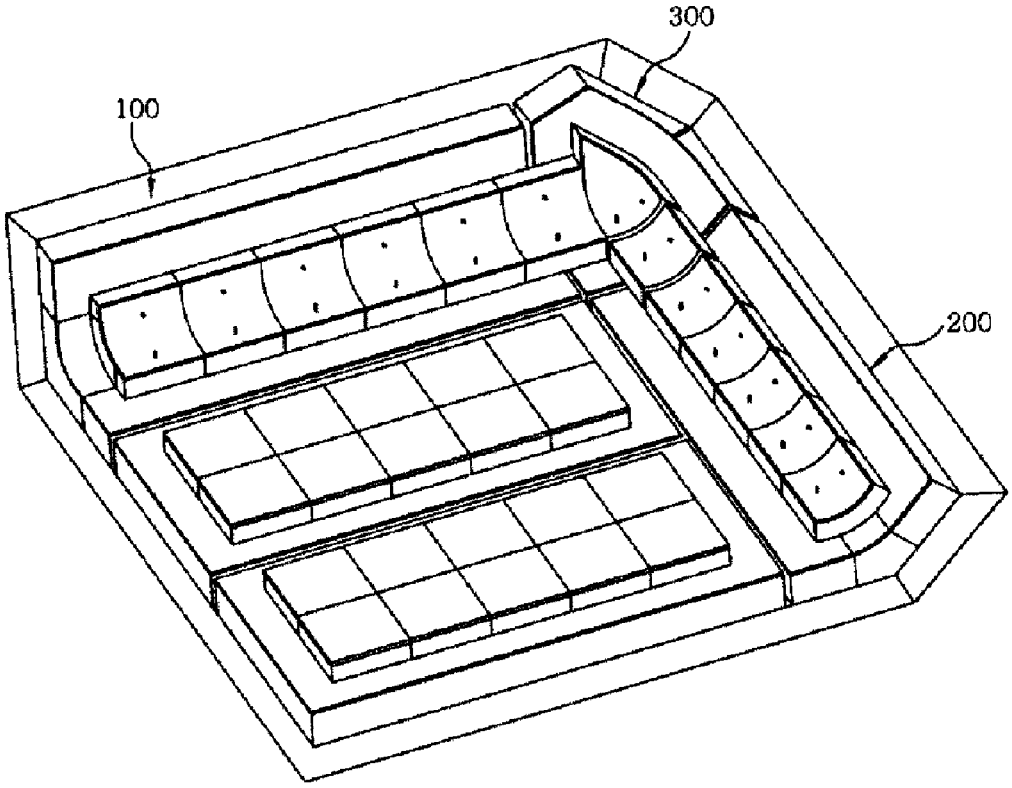
FIG. 10 is a perspective view of a portion of an LNG cargo in which the corner panel of the LNG cargo in accordance with the present invention is applied.

Therefore, the LNG cargo can be constituted by various shapes of corner panels depending on the angle and shape at which the flat areas cross one another, and as illustrated in FIG. 10, the LNG cargo can be manufactured by the combination of corner panels 100, 200, 300 of the LNG cargo in accordance with various embodiments.

As in the case of the corner panel 400 of the LNG cargo in accordance with the fourth embodiment of the present invention illustrated in FIG. 8, convergence of stress can be reduced by forming the slit 430 between the main body 410 and the stress diverging part 420 so as to block the stress converged at the corner area. Moreover, as in the case of the corner panel 500 of the LNG cargo in accordance with the fifth embodiment of the present invention illustrated in FIG. 9, convergence of stress can be greatly reduced by forming the linear or curved slope 526 at the boundaries of the stress diverging part 520.

According to the above embodiments of the present invention, by forming the corner area of the LNG cargo in a single body having a round-shaped curvature, convergence of stress caused by the deformation of the hull and thermal deformation can be prevented, and possibility of crack in the secondary barrier can be removed. By allowing the secondary barrier to be formed in a curved shape, the constructability of the secondary barrier can be greatly improved. Since no hardwood key or plywood is required, the thickness of the primary barrier can be reduced as the stress is decreased and the reliability of the secondary barrier is improved, and the weight can be greatly reduced over the conventional cargo corner area.

Figure 11:
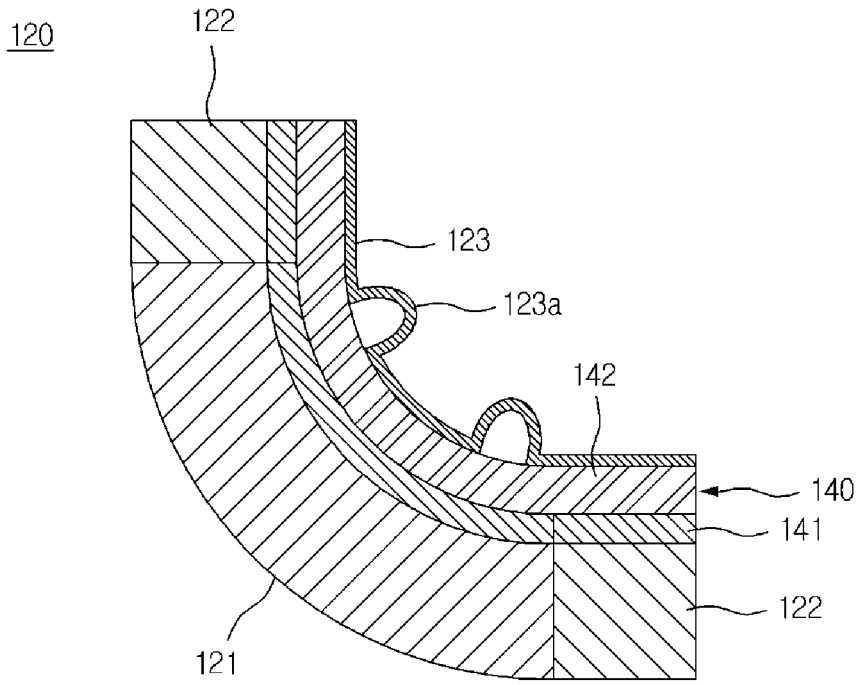
FIG. 11 is a sectional view illustrating an example of a shock-absorbing member applied to the corner panel of the LNG cargo in accordance with the first embodiment of the present invention.

Illustrated in FIG. 11 is an example of a shock-absorbing member applied to the corner panel of the LNG cargo in accordance with the first embodiment of the present invention.

Referring to FIG. 11, a shock-absorbing member 140 is interposed between the primary barrier 123 and the internal face, which is a surface toward the inside of the cargo formed by the curvature member 121 of the stress diverging part 120 and the cuboidal members 122. Here, used as an example of the primary barrier 123 is a corrugated membrane, in which corrugations 123*a* are formed.

The shock-absorbing member 140, which is a member that absorbs the impact load or stress exerted on the primary barrier 123 by sloshing, can be made of a material such as high polymer resin or rubber, which is less rigid than the insulating materials of the curvature member 121 and the cuboidal members 122. Moreover the shock-absorbing member 140 can have various shapes, such as a plate 142, a sheet (not shown) and a mesh (not shown).

Therefore, in case impact load or stress is exerted on the primary barrier 123, the shock-absorbing member 140 absorbs the impact load or stress and prevents the curvature member 121 and the cuboidal members 122 from being deformed or cracked.

The internal faces of the curvature member 121 and cuboidal members 122 can be damaged if friction is caused between the internal faces of the curvature member 121 and cuboidal members 122 and the primary barrier 123 by the impact load or stress exerted on the primary barrier 123. Therefore, a lubricant can be coated on both surfaces of the shock-absorbing member 140 to reduce the friction.

Interposed between the internal faces of the curvature member 121 and cuboidal members 122 and the shock-absorbing member 140 is a composite or a plywood panel 141, which prevents the internal faces of the curvature member 121 and cuboidal members 122 from being damaged when the impact load or stress exerted on the primary barrier 123 is converged at a small area. Here, the composite is molded by mixing resin and fiber material. For example, the composite can be molded by mixing epoxy resin in glass fiber, carbon fiber or a compound of glass fiber and carbon fiber.

In case the shock-absorbing member 140 is in the shape of a flat plate, as illustrated, the composite or plywood panel 141 may not be installed.

Figure 12:
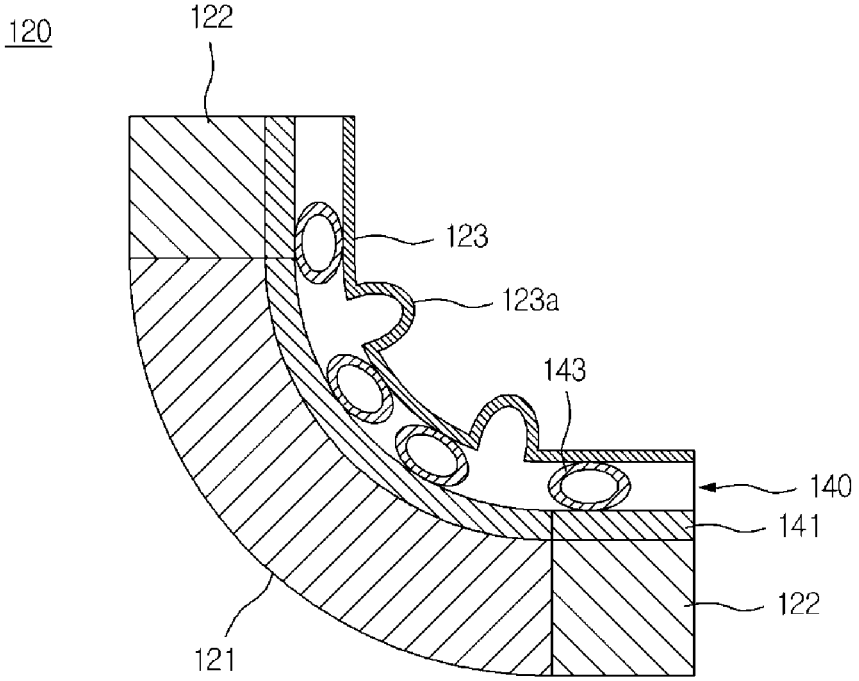
FIG. 12 is a sectional view illustrating another example of a shock-absorbing member applied to the corner panel of the LNG cargo in accordance with the first embodiment of the present invention.

Illustrated in FIG. 12 is another example of the shock-absorbing member applied to the corner panel of the LNG cargo in accordance with the first embodiment of the present invention.

Referring to FIG. 12, a plurality of tubes 143 are used as the shock-absorbing member 140. The tube 143 is formed with a hollow part such that the tube 143 is deformed when force is exerted in a direction that is perpendicular to its length and then returns to its original shape when no force is exerted on the tube 143.

Therefore, if impact load or stress is applied on the primary barrier 123, the tube 143 absorbs the impact load or stress to protect the curvature member 121 and the cuboidal members 122.

When the impact load or stress is applied on the primary barrier 123, force can be converged at areas where the curvature member 121, the cuboidal members 122 and the tubes 143 meet. The converged force can damage or deform the curvature member 121 or the cuboidal members 122.

Therefore, by interposing the composite or the plywood panel 141 between the internal faces of the curvature member 121 and cuboidal members 122 and the shock-absorbing member 140, the internal faces of the curvature member 121 and cuboidal members 122 are prevented from being damaged or deformed.

Figure 13:
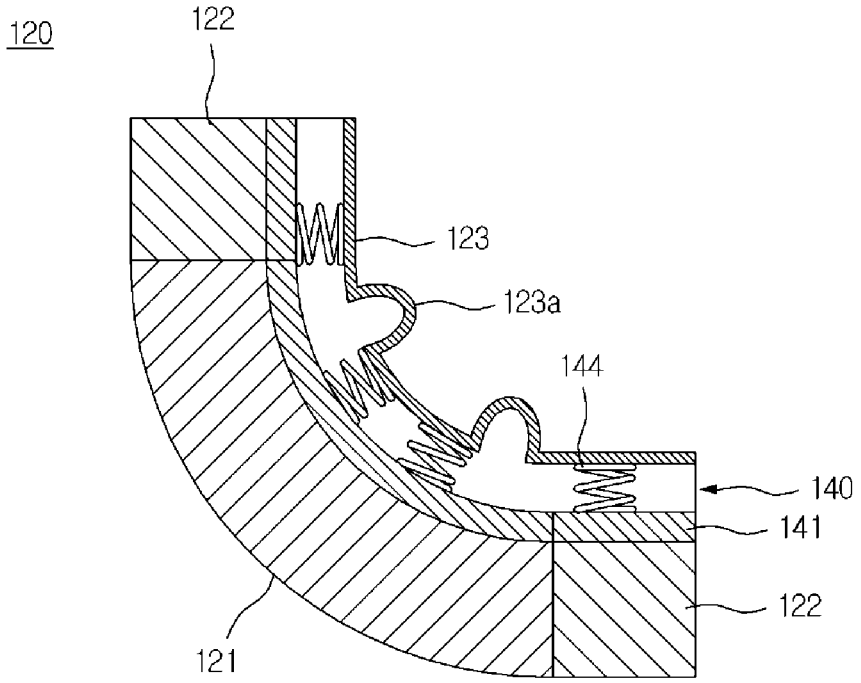
FIG. 13 is a sectional view illustrating yet another example of a shock-absorbing member applied to the corner panel of the LNG cargo in accordance with the first embodiment of the present invention.

Illustrated in FIG. 13 is yet another example of the shock-absorbing member applied to the corner panel of the LNG cargo in accordance with the first embodiment of the present invention.

Referring to FIG. 13, a plurality of elastic bodies 144 are used as the shock-absorbing member 140. Volute springs, disc springs, leaf springs, etc. can be used for the elastic body 144.

Therefore, when impact load or stress is applied on the primary barrier 123, the elastic bodies 144 absorb the impact load or stress to protect the curvature member 121 and cuboidal members 122.

When the impact load or stress is applied on the primary barrier 123, force can be converged at areas where the curvature member 121, the cuboidal members 122 and the elastic bodies 144 meet. The converged force can damage or deform the curvature member 121 or the cuboidal members 122.

Therefore, by interposing the composite or the plywood panel 141 between the internal faces of the curvature member 121 and cuboidal members 122 and the shock-absorbing member 140, the internal faces of the curvature member 121 and cuboidal members 122 are prevented from being damaged or deformed.

Figure 14:
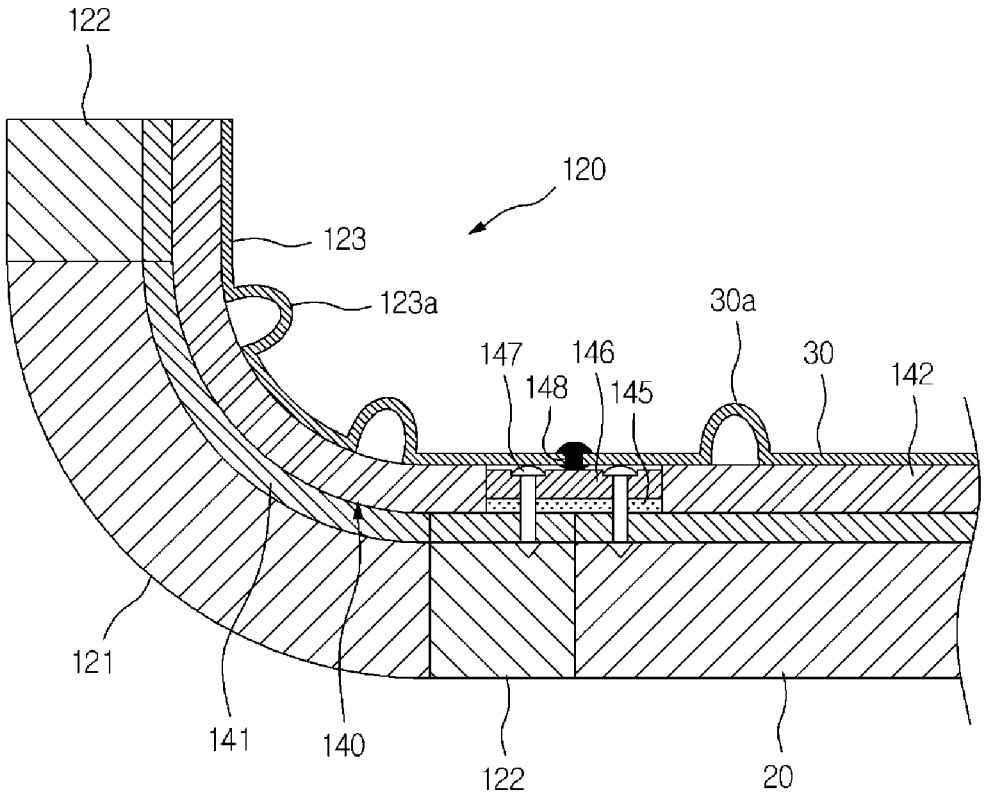
FIG. 14 is a sectional view illustrating an example of a supplementary shock-absorbing member applied to the corner panel of the LNG cargo in accordance with the first embodiment of the present invention.

Illustrated in FIG. 14 is an example of a supplementary shock-absorbing member applied to the corner panel of the LNG cargo in accordance with the first embodiment of the present invention.

Referring to FIG. 14, a supplementary shock-absorbing member 145 is applied where the stress diverging part 120 is connected with an adjacent flat-plate-shaped panel.

The supplementary shock-absorbing member 145 is arranged over the plywood panel 141, and a metal adhesive plate 146 is arranged over the supplementary shock-absorbing member 145. The supplementary shock-absorbing member 145 and the metal adhesive plate 146 are coupled to the plywood panel 141 by a fastening member 147 such as a rivet. A boundary area 148 of the primary barrier 123 is welded on an upper face of the metal adhesive plate 146.

The supplementary shock-absorbing member 145 can be made of high polymer resin or rubber and can have various shapes, such as a plate 142, a sheet (not shown) and a mesh (not shown).

Therefore, when impact load or stress is exerted on the primary barrier 123, the force is transferred to and absorbed by the supplementary shock-absorbing member 145 through the metal adhesive plate 146. Here, an undescribed reference numeral is the top insulation panel 20, which is arranged on a flat-plate-shaped panel that is not illustrated in its entirety.

Although some embodiments have been described hitherto, it shall be apparent that the present invention can be readily modified or permutated by a person of ordinary skill in the art to which the present invention pertains, and such modified or permutated embodiments shall be included in the appended claims.

The invention claimed is:

1. A corner panel of an LNG cargo, comprising:

a main body formed integrally as a single body and arranged at a corner area of the cargo and comprising an external face and an internal face, the external face having a corner corresponding to the corner area, the internal face is formed with a curved surface having a first curvature;

a stress diverging part including a curvature member, is configured to rest against the curved surface of the curvature of the main body in order to reduce convergence of stress of the main body, wherein the curvature member having a second curvature corresponding to the internal face of the main body such that an external face of the curvature member rest against the internal face of the main body; and a primary barrier is arranged over an internal face of the curvature member, a secondary barrier is arranged over the internal face of the main body, wherein the secondary barrier is interposed between the internal face of the main body and the external face of the curvature member, and wherein the secondary barrier having a same curvature corresponding to the internal face of the main body.

2. The corner panel of claim 1, wherein the stress diverging part further comprises a shock-absorbing member interposed between the curvature member and the primary barrier.

3. The corner panel of claim 2, wherein a lubricant is coated on both faces of the shock-absorbing member.

4. The corner panel of claim 2, wherein the stress diverging part further comprises a composite or a plywood panel interposed between the curvature member and the shock-absorbing member.

5. The corner panel of claim 4, wherein the composite is molded by mixing epoxy resin in glass fiber, carbon fiber or a compound of glass fiber and carbon fiber.

6. The corner panel of claim 2, wherein the shock-absorbing member is one of a plate, a sheet and a mesh.

7. The corner panel of claim 1, wherein the stress diverging part comprises:

a composite of a plywood panel interposed between the curvature member and the primary barrier;

a supplementary shock-absorbing member interposed between the composite or plywood panel and the primary barrier;

a metal adhesive plate interposed between the supplementary shock-absorbing member and the primary barrier; and a plurality of fastening members coupling the supplementary shock-absorbing member and the metal adhesive plate to the plywood panel, wherein a boundary area of the primary barrier is welded on an upper face of the metal adhesive plate.

* * * * *